US006109806A

United States Patent [19]

Asano

[11] Patent Number: 6,109,806

[45] Date of Patent: Aug. 29, 2000

[54] MECHANISM FOR PREVENTING RECORDING SHEET FROM CONTACTING PRINT HEAD IN PRINTING DEVICE

[75] Inventor: Kazuya Asano, Nagoya, Japan

[73] Assignee: Brother Kogyo Kabushikik Kaisha, Nagoya, Japan

[21] Appl. No.: 09/095,762

[22] Filed: Jun. 11, 1998

[30] Foreign Application Priority Data

Jun. 19, 1997 [JP] Japan ..... 9-162181
Jun. 19, 1997 [JP] Japan ..... 9-162182

[51] Int. Cl.[7] ..... B41J 13/10

[52] U.S. Cl. ..... 400/642; 400/645; 400/585; 400/645.5

[58] Field of Search ..... 400/642, 645, 400/584, 585, 619, 645.5, 647.1, 616.1, 656, 662

[56] References Cited

U.S. PATENT DOCUMENTS

| | | | |
|---|---|---|---|
| 4,491,854 | 1/1985 | Habelt et al. | 400/641 X |
| 5,281,442 | 1/1994 | Fulton et al. | 427/374.5 |
| 5,419,644 | 5/1995 | Martin et al. | 400/642 |
| 5,534,902 | 7/1996 | Hoesly | 400/645 X |
| 5,672,018 | 9/1997 | Yamamoto et al. | 400/613.3 |
| 5,673,074 | 9/1997 | Miyauchi et al. | 400/645 X |
| 5,724,888 | 3/1998 | Okuda et al. | 101/116 |
| 5,742,318 | 4/1998 | Miyauchi et al. | 400/618 X |
| 5,820,283 | 10/1998 | Sunada et al. | 400/642 |
| 5,874,979 | 2/1999 | Ohyama | 400/642 X |

*Primary Examiner*—John S. Hilten
*Assistant Examiner*—Minh H. Chau
*Attorney, Agent, or Firm*—Oliff & Berridge, PLC

[57] ABSTRACT

A hot melt ink jet printing device 1 includes guides 27 disposed on a printing surface 11 of a platen 12 at both sides of a print area and guides 28 disposed downstream side of the platen 12 in a sheet feed direction F. Heaters 21, 25 are mounted on an under surface of the platen 12 for applying heat to a recording sheet 7 placed on the printing surface 11. The print head 13 is disposed away from the platen 12 such that a nozzle surface 13*a* of the print head 13 confront the printing surface 11. The guides 27, 28 effectively prevent the recording sheet 7 from rising off the printing surface 11 toward the print head 13 when the recording sheet 7 is supplied with heat from the heater 21, 25. In this way, the recording sheet 7 is prevented from contacting the nozzle surface 13*a*.

11 Claims, 6 Drawing Sheets

MECHANISM FOR PREVENTING RECORDING SHEET FROM CONTACTING PRINT HEAD IN PRINTING DEVICE

BACKGROUND OF THE INVENTION

1. Field of the Invention

The present invention relates to a printing device, more specifically, to an ink jet printing device in which heat is applied to a recording sheet during a printing operation.

2. Description of the Related Art

There has been known an ink jet printing device capable of printing a high quality image on a recording sheet. Especially an ink jet printing device using hot melt ink has been well known for capability of printing an image at high speeds. The hot melt ink is in a solid state at room temperature and melted when heated. A conventional hot melt ink jet printing device includes a print head, a platen, and a heater. The heater is attached on a lower surface of the platen. The print head has a nozzle surface formed with a plurality of nozzles. The print head is away from the platen such that the nozzle surface confronts an upper surface called a printing surface of the platen. During printing operation, the hot melt ink is melted and supplied to the print head. Also, the platen is heated by the heater. When a recording sheet is placed on the printing surface of the platen, melted ink is ejected through the nozzles of the print head toward the recording sheet, thereby forming an image on the recording sheet. Because the recording sheet is heated by the heat from the heater, ink ejected onto the recording sheet can be reliably fixed onto the recording sheet. Thus formed image is excellent in resistant to fading.

However, when the recording sheet is heated on the platen, moisture contained in the recording sheet evaporates. This may cause edges of the recording sheet to curl up toward the print head. When the recording sheet contacts the nozzle surface of the print head, the recording sheet is stained. Also, this may cause recording sheet jams.

In order to overcome this problem, a distance between the printing surface and the print head may be increased. However, this degrades quality of printed images. Also, heating temperature of the printing surface may be lowered. In this case, however, ink forming the images can fix onto the recording sheet less securely.

SUMMARY OF THE INVENTION

It is an object of the present invention to solve the above problems and also to provide a printing device capable of printing high quality images by preventing a recording sheet mounted on a printing surface from rising toward a print head even when supplied with heat.

In order to accomplish the above and other objects, there is provided a print unit including a feed roller, a platen, a print head, and a guide. The feed roller feeds a recording medium in a sheet feed direction. The platen has a printing surface for receiving the recording medium and a width in a widthwise direction. The printing surface has a print area defined by sides extending in the sheet feed direction. The recording medium has sides corresponding to the sides of the print area. The print head is disposed away from the platen by a predetermined distance and confronting with the printing surface. The guide is disposed on the printing surface to be in alignment with at least one of the sides of the print area. The guide prevents a corresponding one of the sides of the recording medium from rising off the printing surface and from curling toward the print head.

There is also provided a print unit including a feed roller, a platen, a print head, and a guide. The feed roller feeds a recording medium in a sheet feed direction. The platen has a printing surface for receiving the recording medium and a width in a widthwise direction. The printing surface having a print area defined by sides extending in the sheet feed direction. The recording medium has sides corresponding to the sides of the print area. The print head is disposed away from the printing surface by a predetermined distance. The guide is disposed downstream of the platen with respect to the sheet feed direction. The guide prevents a corresponding one of sides of the recording medium from rising off the printing surface and from curling toward the print head. At least a portion of the guide is positioned at further inward position in the widthwise direction than the corresponding one of the sides of the print area.

There is also provided a print unit including a feed member, a platen, a print head, and a guide. The feed member feeds a recording medium in a sheet feed direction. The platen has a width in a widthwise direction and a printing surface for receiving the recording medium. The printing surface is formed with a plurality of through-holes arranged in a line extending in the widthwise direction. The print head is disposed away from the platen by a predetermined distance and confronting the printing surface. The print head ejects ink onto the recording medium received on the printing surface. The guide is disposed on the printing surface at a position upstream of the plurality of through-holes with respect to the sheet feed direction. The guide prevents the recording medium from rising off the printing surface and lifting toward the print head.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

Figure 1:
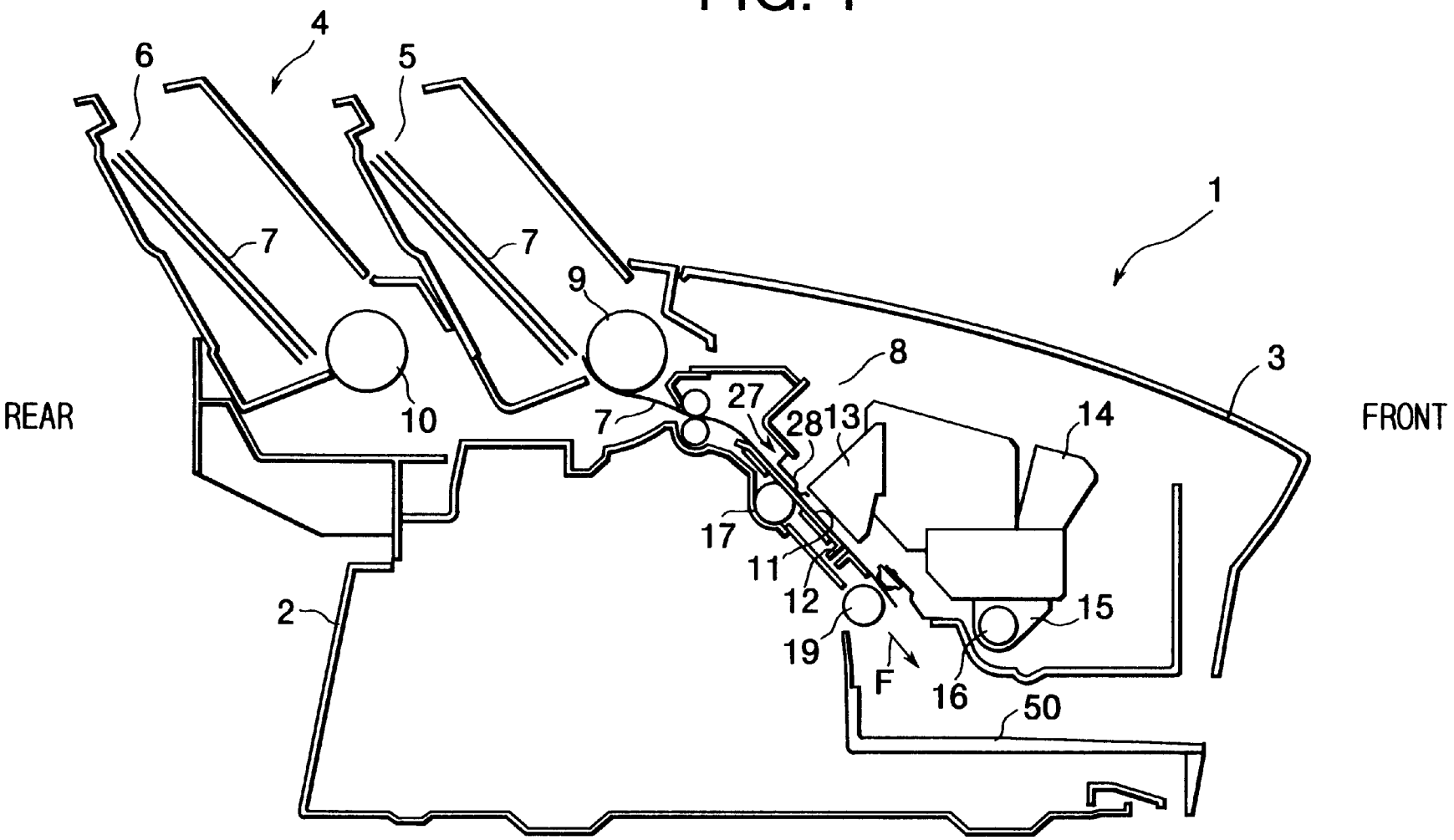
FIG. 1 is a plan view showing an ink jet printing device of an embodiment of the present invention.

A printing device according to a preferred embodiment of the present invention will be described while referring to the accompanying drawings wherein like parts and components are designated by the same reference numerals to avoid duplicating description.

In the following description, the expressions "front", "rear", "upper", and "lower". . . are used throughout the description to define the various parts when the printing device is disposed in an orientation in which it is intended to be used.

As shown in FIG. 1, an ink jet printing device 1 includes a lower cover 2, an upper cover 3, a sheet supply mechanism 4, a print unit 8, and a tray 50. The lower cover 2 and the upper cover 3 form a frame of the ink jet printing device 1. The sheet supply mechanism 4 is disposed at an upper rear end of the frame for supplying recording sheets one at a time to the print unit 8. The print unit 8 prints an image on the recording sheet supplied from the sheet supply mechanism 4. Then, the recording sheet with the image formed thereon is discharged onto the tray 50 disposed at a front lower end of the frame.

The sheet supply mechanism 4 includes sheet supply trays 5, 6 and feed rollers 9, 10. Each of the sheet supply trays 5, 6 contains a stack of recording sheets 7 in different sizes. Each sheet supply tray 5, 6 has a lower end portion. The feed rollers 9, 10 are disposed near the lower end portions of the corresponding sheet supply trays 5, 6. The feed rollers 9, 10 feed the recording sheets 7 from the sheet supply trays 5, 6 one sheet at a time toward the print unit 8.

Figure 2:
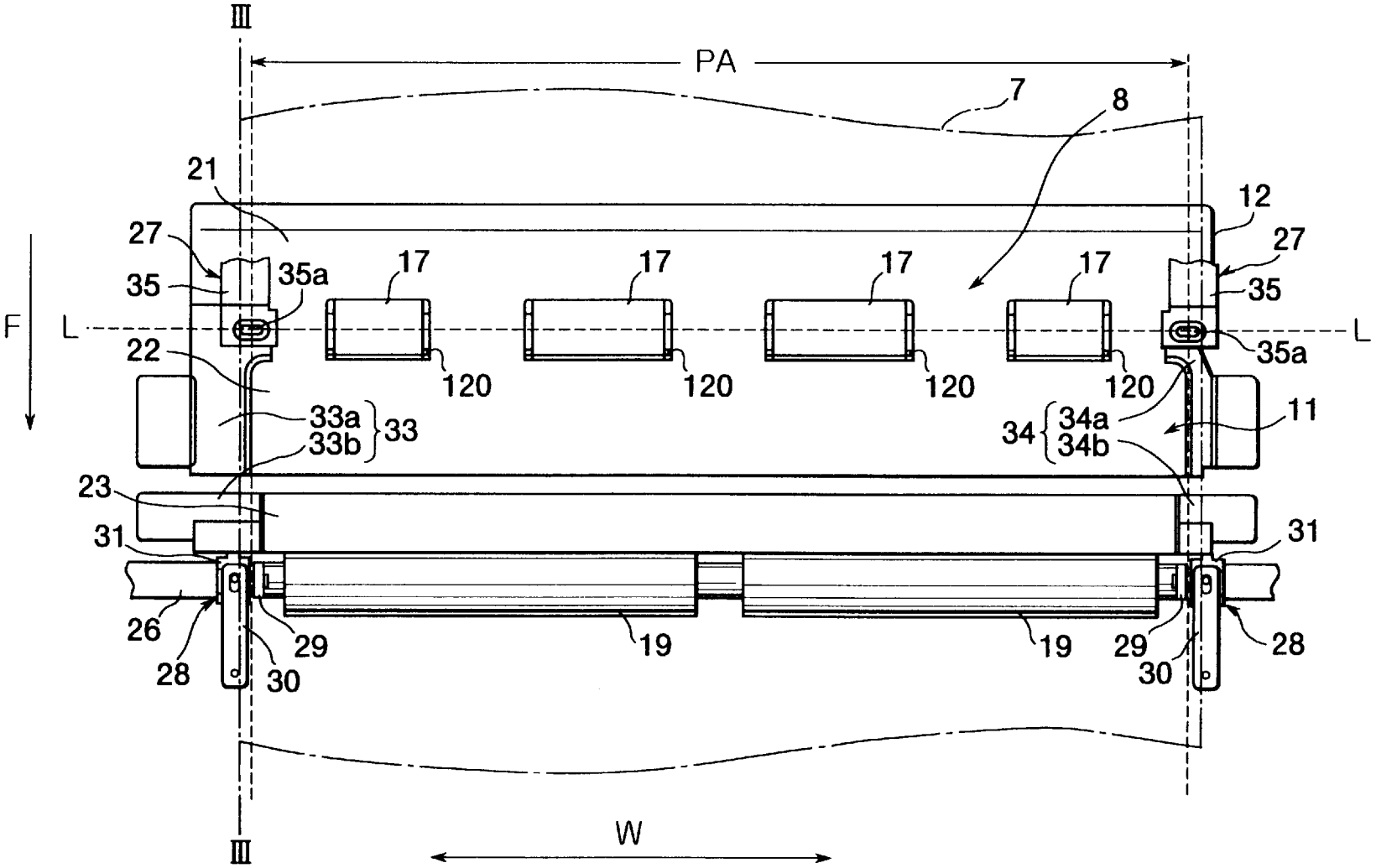
FIG. 2 is a partial plan view showing a print unit of the ink jet printing device of FIG. 1.

The print unit 8 is disposed within the frame in a downstream side of the sheet supply mechanism 4 in a sheet feed direction indicated by an arrow F. The print unit 8 includes a platen 12, a print head 13, a head unit 14, a carriage 15, and a guide member 16. The platen 12 has a printing surface 11 on which the recording sheet 7 is received. The platen 12 has a width in a widthwise direction indicated by an arrow W (FIG. 2). The print head 13 has a nozzle surface 13*a* formed with a plurality of nozzles (not shown). The print head 13 is disposed away from the printing surface 11 by a predetermined distance such that the nozzle surface 13*a* confronts the printing surface 11. The print head 13 is mounted on the head unit 14. Although not shown in the drawings, the head unit 14 includes an ink tank for storing hot melt ink and a heater for melting the hot melt ink. Melted ink is supplied to the print head 13. The head unit 14 is mounted on the carriage 15. The guide member 16 extends in the widthwise direction W. The carriage 15 is slidably mounted on the guide member 16. A drive mechanism (not shown) moves the carriage 15 with print head 13 mounted thereon back and forth over the guide member 16.

Figure 3:
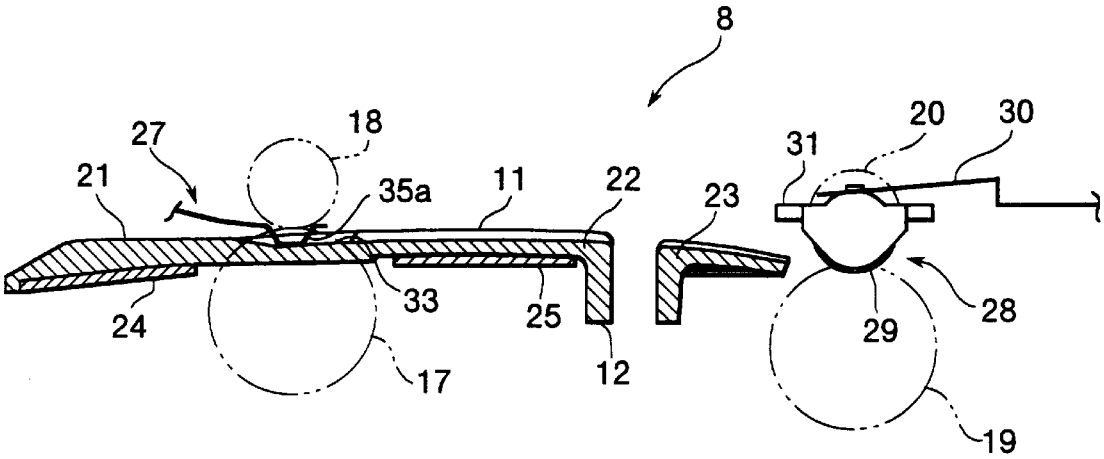
FIG. 3 is a cross-sectional view showing the print unit taken along a line III—III of FIG. 2.

Next, the print unit 8 will be described further in detail. As shown in FIGS. 1 to 3, the platen 12 includes a pre-platen 21, a main platen 22, and a cooling platen 23 arranged in this order in the sheet feed direction F. The pre-platen 21, the main platen 22, and the cooling platen 23 have upper surfaces and under surfaces. The upper surfaces are collectively called the printing surface 11 on which the recording sheet 7 is received. An image is formed on the recording sheet 7 placed on the main platen 22. The main platen 22 is formed continuously and integrally with the pre-platen 21. The cooling platen 23 is disposed away from the main platen 22 by a predetermined distance. The platen 12 is formed with a plurality of through-holes 120 along a border line indicated by a broken line L between the pre-platen 21 and the main platen 22.

As shown in FIGS. 1 to 3, the print unit 8 further includes a pre-heater 24, a main heater 25, a plurality of feed rollers 17, 18, a plurality of discharge rollers 19, 20, a shaft 26, and a mechanism of preventing the recording sheet 7 from curling up to be described later. As shown in FIG. 3, the pre-heater 24 is mounted on the under surface of the pre-platen 21. The main heater 25 is mounted on the under surface of the main platen 22.

A shaft (not shown) is rotatably provided below the platen 12 and extends along the border line L. The plurality of the feed rollers 17 are disposed on the shaft such that a portion of each feed roller 17 exposes above the printing surface 11 through a corresponding one of the through-holes 120. The feed rollers 18 are rotatably disposed above and in contact with the feed rollers 17. The feed rollers 17, 18 feed the recording sheet 7 supplied from the sheet supply mechanism 4 further in the sheet feed direction F.

The shaft 26 is rotatably disposed at a downstream side of the platen 12 in the sheet feed direction F, and extends in the widthwise direction W. The discharge rollers 19 are mounted on the shaft 16. The discharge rollers 20 are rotatably disposed above and in contact with the discharge rollers 19. The discharge rollers 19, 20 discharge the recording sheet 7 onto the tray 50.

Next, a printing operation of thus configured ink jet printing device 1 will be described. First, recording sheets 7 stored in the sheet supply trays 5, 6 are supplied one sheet at a time to the print unit 8. Then, the recording sheet 7 is received onto the pre-platen 21 and guided to the main platen 22. At this time, the recording sheet 7 is preheated by the pre-heater 24. The recording sheet 7 is further fed by the feed rollers 17, 18 in the sheet feed direction F and received onto the main platen 22. The print head 13 ejects ink as an ink droplet through the nozzles onto the recording sheet 7 while the carriage 15, that is, the print head 13, is moved back and forth over the shaft 16, thereby forming an image on the recording sheet 7. At this time, the recording sheet 7 is heated by the main heater 25. The heat from the main heater 25 fixes the ink image formed on the recording sheet 7 to the recording sheet 7. The recording sheet 7 with the image formed thereon is received onto the cooling platen 23 and allowed to cool. Finally, the discharge rollers 19, 20 discharge the recording sheet 7 onto the tray 50.

Next, a mechanism of the print unit 8 for preventing the recording sheet 7 from rising off the printing surface 11 toward the print head 13 will be described.

It should be noted that the print head 13 is capable of printing within a predetermined limited area, called a print area PA shown in FIG. 2. The print area PA has sides opposing each other in the widthwise direction W.

As shown in FIGS. 2 and 3, the print unit 8 further includes a pair of guides 27 and a pair of guides 28. The guides 27 and the guides 28 are disposed at an upstream side and a downstream side, respectively, of the print unit 8 in the sheet feed direction F for preventing the recording sheet 7 from rising off the printing surface 11 toward the print head 13.

More specifically, the guides 27 are disposed on the border line L above the platen 12 at the both sides of the print area PA. Each guide 27 includes a flexible leaf spring 35. The leaf spring 35 has a fixed end fixed to a fixed position and a free end portion opposite from the fixed end. The leaf spring 35 is swingable upward and downward about the fixed end. The free end portion is formed with a protrusion 35*a* protruding toward the printing surface 11. The leaf spring 35 is urged such that the protrusion 35*a* presses the printing surface 11.

The guides 28 are provided on and above the shaft 26 at the both sides of the print area PA. Each guide 28 includes a roller 29, a leaf spring 30, and a pressing member 31. The roller 29 is formed of a material to which ink will not easily transfer. For example, the roller 29 can be formed of ethylene propylene rubber. It is also effective to coat the roller 29 with silicon or teflon. The roller 29 is rotatably supported by the pressing member and disposed within the print area PA. The leaf spring 30 has a fixed end fixed to a fixed position and a free end portion capable of bending elastically upward and downward. The pressing member 31 is attached to the free end portion. In this way, the roller 29 is urged to press the shaft 26 by the leaf spring 30.

As shown in FIG. 2, the printing surface 11 is formed with grooves 33, 34. The grooves 33, 34 are formed continuously across the main platen 22 and the cooling platen 23 at each side of the print area PA. The grooves 33, 34 provide spaces allowing the side edges of the recording sheet 7 to curl away from the print head 13. More specifically, the groove 33 includes a first groove 33*a* and a second groove 33*b*. The first groove 33*a* is formed on the main platen 22 at position corresponding to the guide 27. The second groove 33*b* is formed on the cooling platen 23 from farther inward than the first groove 33*a* in the widthwise direction W. Also, the groove 34 includes a first groove 34*a* and a second groove 34*b*. The first groove 34*a* is formed on the main platen 22 at position corresponding to the guide 27. The second groove 34*b* is formed on the cooling platen 23 from farther inward than the first groove 34*a* in the widthwise direction W.

Next, operations and effects of the guides 27, 28 and grooves 33, 34 will be described. When the recording sheet 7 on the main platen 22 is applied with heat from the main heater 25, the side edges of the recording sheet 7 tend to curl up toward the print head 13. However, because the guides 27 prevents the recording sheet 7 from rising up, the recording sheet 7 stays on the printing surface 11. In this way, the recording sheet 7 is prevented from being stained by contacting the nozzle surface 13*b* of the print head 13, and also recording sheet jams can be prevented. Further, because the distance between the printing surface 11 and the print head 13 need not to be increased for preventing the printing sheet 7 from contacting the nozzle surface 13*a*, a quality of a printed image can be maintained. Also, because the recording sheet 7 can be heated to a desirable temperature, that is, because there is no need to reduce the heat temperature, ink can be properly fixed to the recording sheet 7.

Because the guides 27 are provided to the both sides of the print area PA, the recording sheet 7 is effectively prevented from floating upward. Moreover, in addition to the guides 27, the guides 28 are provided at downstream of the guides 27 in the sheet feed direction F, the recording sheet 7 can be further effectively prevented from rising upward.

As described above, the guides 27 include the leaf springs 35 pressing the recording sheet 7 downward. Also, the leaf springs 35 can bend elastically upward and downward. Therefore, the guides 27 can press the printing sheet 7 regardless of a thickness of the printing sheet 7 without damaging the recording sheet 7. Also, because the rollers 29 rotatably contact the recording sheet 7 without applying friction thereto, the recording sheet 7 can be discharged without damage.

Also, because the rollers 29 are disposed within the print area PA, the recording sheet 7 can be further effectively prevented from curling up. More specifically, the hot melt ink jet printing device 1 includes the main platen 22 and cooling platen 23 as described above. Therefore, a distance between the feed roller 17 and the discharge roller 18 is relatively large. For this reason, if the rollers 29 were provided outside of the print area PA, even if the edges of the recording sheet 7 are pressed downward at both the upstream side and the downstream side, the recording sheet 7 would not be sufficiently prevented from curling. However, in the present embodiment, the rollers 29 are provided within the print area PA. Therefore, the rollers 29 can effectively prevent the recording sheet 7 from lifting up. Also, because the rollers 29 are made of the material on which the ink will not be easily transferred, and also because the rollers 29 rotatably contact the recording sheet 7, the quality of the printed image on the recording sheet 7 will not be degraded even if the rollers 29 contact the printed image on the recording sheet 7.

Also, the grooves 33, 34 allow the recording sheet 7 to be bent away from the print head 13 continuously along the lengthwise sides of the recording sheet 7.

Further, as described above, the grooves 33*b*, 34*b* are formed at further inward than the grooves 33*a*, 33*b*, respectively, in the widthwise direction W. Therefore, although side edges of the recording sheet 7 just released from the pressing springs 27 are most predisposed to curl, the side edges are forcefully bent into the grooves 33, 34. The recording sheet 7 is further effectively prevented from rising up.

Because the grooves 33, 34 are formed on the printing surface 11, there is no need to prepare additional separate components for providing spaces that allow the recording sheet 7 to bend.

In this way, the recording sheet 7 is effectively prevented from rising off the printing surface 11 toward the print head 13.

It should be noted that as long capable of preventing the sheet 7 from lifting, any shaped guides can be used instead of the guides 27, 28. For example, guide plates having side portions which have an upsided-down L shaped cross-sectional surface can be provided continuously across the lengthwise direction L.

Next, a print unit 8A according to a first modification and a print unit 8B according to a second modification will be described.

Figure 5:
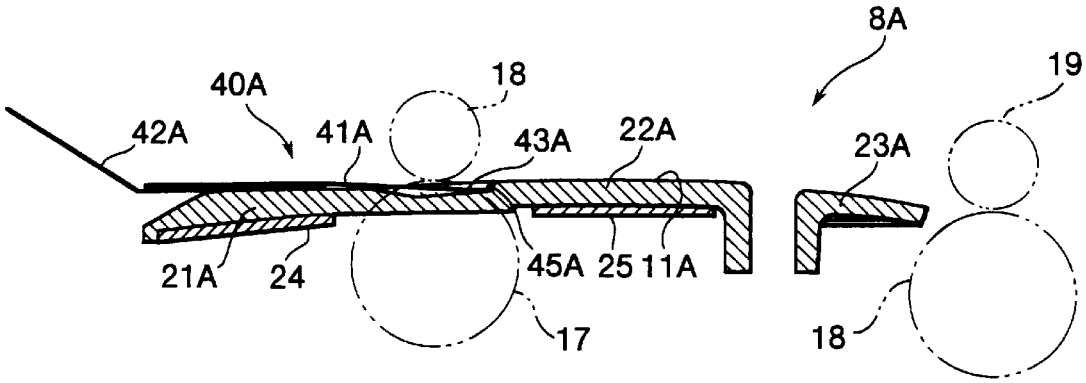
FIG. 5 is a cross-sectional view showing the print unit taken along a line V—V of FIG. 4.
Figure 4:
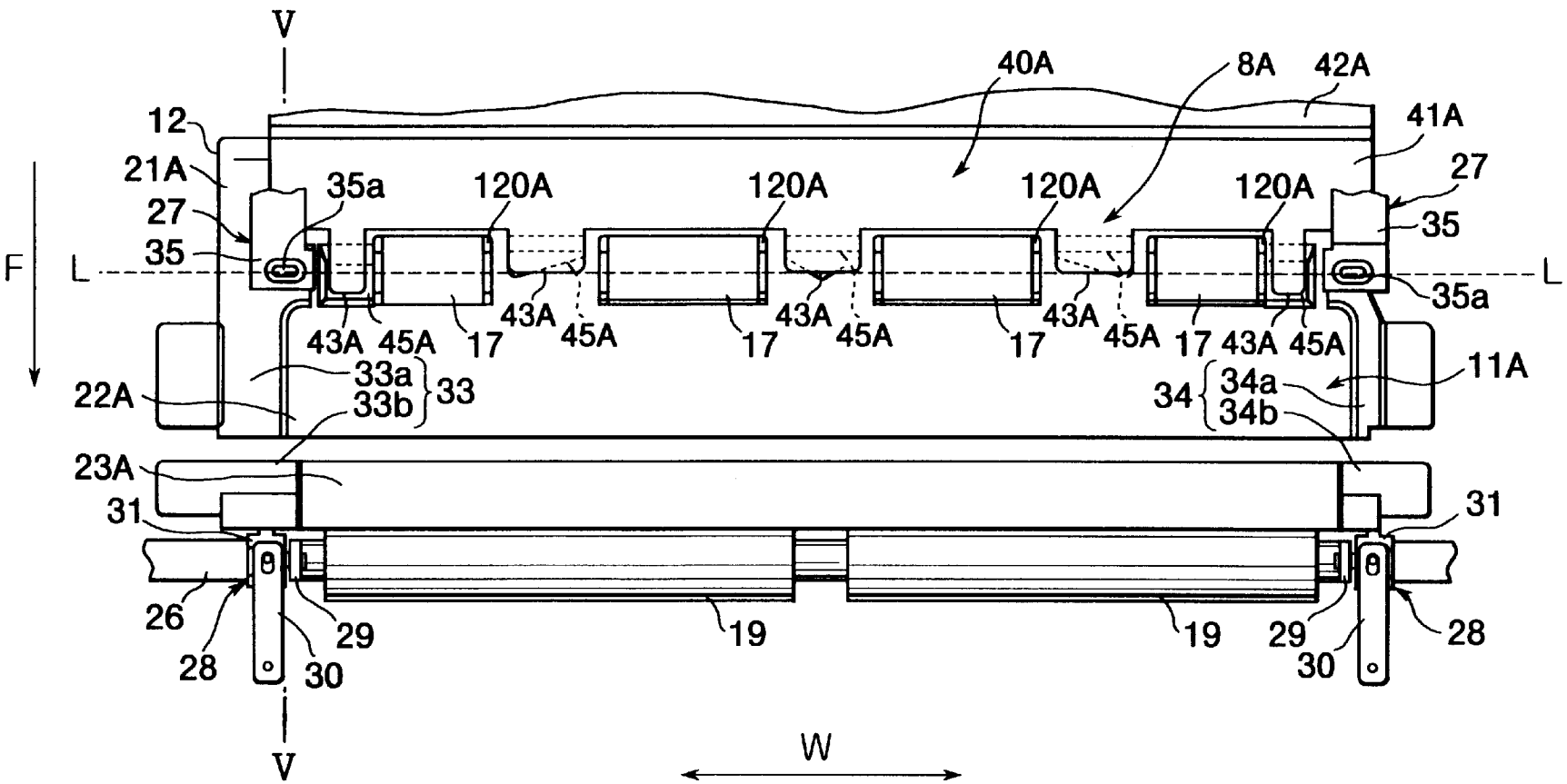
FIG. 4 is a partial plan view showing a print unit of an ink jet printing device according to a first modification of the embodiment of the present invention.

First, the print unit 8A according to the first modification will be described while referring to FIGS. 4 and 5. A print unit 8A is basically the same as the print unit 8 except that the print unit 8A includes an additional guide 40A, and that a printing surface 11A is formed with a plurality of grooves 45A.

The guide 40A is provided on the printing surface 11A within the print area PA at the upstream side of a platen 12A in the sheet feed direction F. The guide 40A includes a film 41A, a pre-baffle 42A, and a plurality of pressing members 43A. The pre-baffle 42A extends in the widthwise direction W and is mounted on the printing surface 11. The recording sheet 7 supplied from the sheet supply mechanism 4 is fed between the printing surface 11A and the pre-baffle 42A. When the recording sheet 7 is applied with heat from the pre-heater 24 on the pre-platen 21A, the recording sheet 7 is pressed by the pre-baffle 42A onto the printing surface 11. The film 41A is made of a flexible film, specifically, a heat-resistant polyester film. The film 41A is attached onto the pre-baffle 42A. As shown in FIG. 4, each or the pressing members 43A has a rectangular shape and is integrally formed with the film 41A. The pressing members 43A are disposed within the print area PA such that each feed roller 17 interposes between corresponding adjacent ones of the pressing members 43A. The pressing members 43A elastically bend upward and downward to press the recording sheet 7 onto the printing surface 11. That is, the recording sheet 7 is pressed onto the printing surface 11A by ends of the pressing members 43A.

The grooves 45A are formed on the printing surface 11A at positions corresponding to the pressing members 43A. The grooves 45A allow the recording sheet 7 to bend away from the print head 13.

Because the guide 40A is provided in addition to the guides 27, 28, the recording sheet 7 can be further effectively prevented from rising. Also, because the guide 40A is provided within the print area PA and extending throughout the width of the platen 12A, even a recording sheet 7' shown in FIG. 6 which has a smaller width than the print area PA can be effectively prevented from rising.

Because the flexible film 41A can flexibly bend upward and downward, the pressing members 43A can effectively press the recording sheet 7 regardless of a thickness of the recording sheet 7 without damaging the recording sheet 7. Further, the guide 40A including the film 41A can be provided in a simple manner without requiring a large space.

Because the pressing members 43A press and bend the recording sheet 7 into the grooves 45A, the recording sheet 7 can be effectively prevented from rising toward the print head 13. Also, because the grooves 45A are formed in the printing surface 11A, it is unnecessary to provide any additional components for providing spaces for the recording sheet 7.

Figure 6:
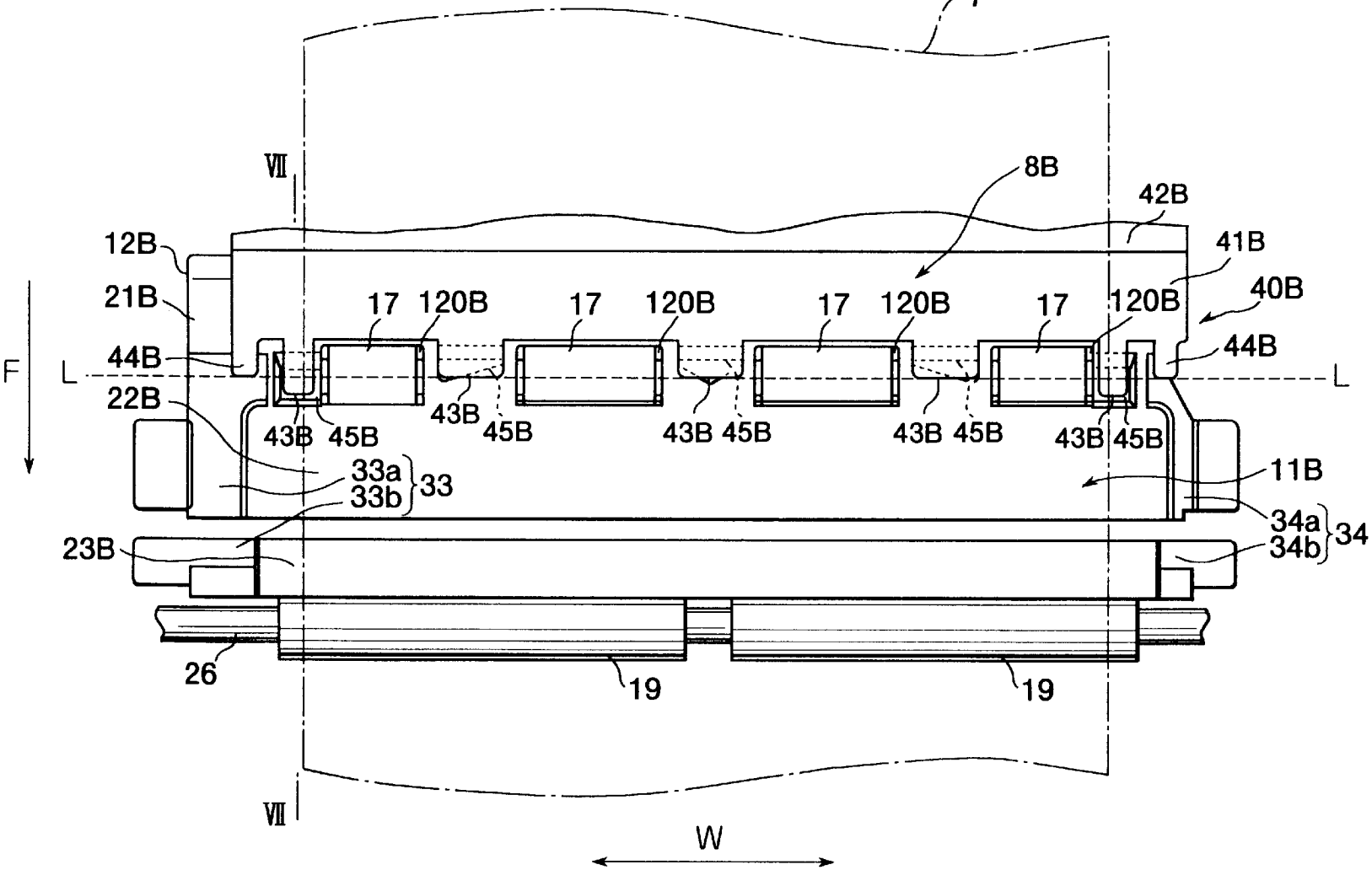
FIG. 6 is a partial plan view showing a print unit of an ink jet printing device according to a second modification of the embodiment of the present invention.
Figure 7:
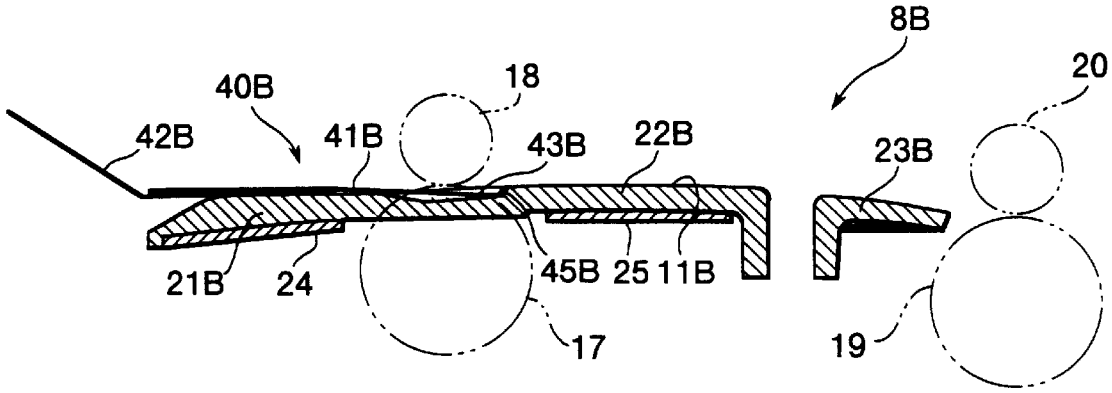
FIG. 7 is a cross-sectional view showing the print unit taken along a line VII—VII of FIG. 6.

Next, the print unit 8B according to the second modification will be described while referring to FIGS. 6 and 7. The print unit 8B is basically the same as the print unit 8A except that the print unit does not include the guides 27, 28, and that additional pressing members 44B are provided. The pressing members 44B are integrally formed with a guide 40B at positions corresponding to the guides 27. The pressing members 44B serve the same function as the guides 27 described above. That is, the guide 40B provides the same effects of a combination of the guides 27 and the guide 40A.

While the invention has been described in detail with reference to specific embodiments thereof, it would be apparent to those skilled in the art that various changes and modifications may be made therein without departing from the spirit of the invention, the scope of which is defined by the attached claims.

For example, the guides 27, 28 are provided at both sides of the print area PA. However, the guides 27, 28 can be provided only either one of the sides of the print area PA.

What is claimed is:

1. A print unit, comprising:

a feed roller that feeds a recording medium in a sheet feed direction;

a platen having a printing surface for receiving the recording medium, the printing surface having a width in a widthwise direction perpendicular to the sheet feed direction, the printing surface having a flat surface portion defining a print area between sides opposing each other and extending in the sheet feed direction, the recording medium having sides extending in the sheet feed direction and corresponding to the sides of the print area;

a print head disposed away from the platen by a predetermined distance so as to confront the printing surface, the print head ejecting ink toward the recording medium on the printing surface; and a guide disposed on the printing surface to be in alignment with at least one of the sides of the print area, the guide preventing a corresponding one of the sides of the recording medium from rising off the printing surface and from curling toward the print head, wherein the platen is formed with a groove extending in the sheet feed direction to be in alignment with at least one of the sides of the print area, the groove on the side edge providing a space that receives the corresponding one of the sides of the recording medium.

2. The print unit according to claim 1, wherein the guide comprises a pressing member that presses the recording medium onto the printing surface.

3. The print unit according to claim 1, wherein the guide is located directly above the groove.

4. The print unit according to claim 1, wherein the platen includes a first platen and a second platen disposed downstream of the first platen with respect to the sheet feed direction, the first platen being formed with a first groove extending in the sheet feed direction along at least one of the sides of the print area, the second platen being formed with a second groove extending in the sheet feed direction, the second groove being formed from further inward in the widthwise direction than the first groove, the first groove and the second groove providing a space that receives a corresponding one of the sides of the recording medium.

5. The print unit according to claim 4, further comprising a heater that generates heat, wherein the first platen has an under surface opposite from the printing surface, and the heater is mounted on the under surface and supplies heat to the recording medium received onto the printing surface.

6. The print unit according to claim 1, wherein the guide includes a baffle disposed on the printing surface and a film having sides opposing each other in the widthwise direction, the film being attached to the baffle such that the printing surface and the film sandwich the baffle.

7. The print unit according to claim 1 further comprising another guide disposed downstream of the platen with respect to the sheet feed direction, the guide preventing corresponding one of the sides of the recording medium from rising off the printing surface and from curling toward the print head, wherein at least a portion of the another guide is positioned at further inward position in the widthwise direction than the corresponding one of the sides of the print area.

8. A print unit, comprising:

a plurality of feed members that feed a recording medium in a sheet feed direction;

a platen having a printing surface for receiving the recording medium, the platen having a width in a widthwise direction perpendicular to the sheet feed direction, the printing surface being formed with a plurality of through-holes arranged in a line extending in the widthwise direction, wherein the feed members protrude through a plurality of the through-holes to contact the recording medium on the printing surface;

a print head disposed away from the platen by a predetermined distance so as to confront the printing surface, the print head ejecting ink onto the recording medium received on the printing surface; and a guide disposed on the printing surface at a position upstream of the plurality of through-holes with respect to the sheet feed direction, a portion of the guide being located between adjacent ones of the plurality of through holes, the portion of the guide preventing the recording medium from rising off the printing surface and lifting toward the print head.

9. The print unit according to claim 8, wherein the guide includes a baffle disposed on the printing surface, a film attached to the baffle such that the printing surface and the film sandwich the baffle therebetween, and a plurality of pressing members integrally formed with the film, the plurality of pressing members protruding from the film in the sheet feed direction, wherein the each of the through-holes is interposed between corresponding adjacent ones of the plurality of the pressing members.

10. The print unit according to claim 9, wherein the guide further includes another pressing members, and the film has sides opposing each other in the widthwise direction, the another pressing members being integrally formed with each of the sides of the film, the each of the another pressing members pressing the recording medium onto the printing surface.

11. The print unit according to claim 8, wherein the guide extends throughout the width of the printing surface.

* * * * *